US012392580B2

(12) United States Patent
Neff

(10) Patent No.: US 12,392,580 B2
(45) Date of Patent: Aug. 19, 2025

(54) FIBER OPTIC HANDGUN SIGHT

(71) Applicant: Michael Ilari Neff, Parker, TX (US)

(72) Inventor: Michael Ilari Neff, Parker, TX (US)

( * ) Notice: Subject to any disclaimer, the term of this patent is extended or adjusted under 35 U.S.C. 154(b) by 0 days.

(21) Appl. No.: 18/371,985

(22) Filed: Sep. 22, 2023

(65) Prior Publication Data

US 2024/0102772 A1 Mar. 28, 2024

Related U.S. Application Data

(60) Provisional application No. 63/409,381, filed on Sep. 23, 2022.

(51) Int. Cl.
*F41G 1/34* (2006.01)
*F41G 1/10* (2006.01)
*F41G 11/00* (2006.01)

(52) U.S. Cl.
CPC ..... *F41G 1/345* (2013.01); *F41G 1/10* (2013.01); *F41G 11/003* (2013.01)

(58) Field of Classification Search
CPC ... F41G 1/345; F41G 1/10; F41G 1/02; F41G 1/32; F41G 11/003
USPC ..... 42/132, 144, 145
See application file for complete search history.

(56) References Cited

U.S. PATENT DOCUMENTS 4,020,203 A * 4/1977 Thuler ..... F41G 1/32 428/428
5,065,519 A * 11/1991 Bindon ..... F41G 1/32 42/145
5,279,061 A * 1/1994 Betz ..... F41G 1/34 42/144
6,122,833 A * 9/2000 Lorocco ..... F41G 1/32 42/132
8,635,801 B2 * 1/2014 Glimpse ..... F41G 1/32 42/131
10,386,158 B2 * 8/2019 Kind ..... F41G 1/345
11,340,041 B2 5/2022 Salamon, III et al.
11,815,332 B2 * 11/2023 Eaton ..... F41G 1/28
2012/0144721 A1 * 6/2012 Glimpse ..... F41G 1/10 42/144
2014/0109460 A1 * 4/2014 Howe ..... F41G 1/08 42/132

* cited by examiner

*Primary Examiner* — John Cooper

(74) *Attorney, Agent, or Firm* — Ilya Chernyavskiy; Bennet K. Langlotz; Langlotz Patent & Trademark Works, LLC

(57) ABSTRACT

A firearm sight has a body having an attachment facility configured to connect to a pistol having a forward target end and a rear end. The body has a forward end and an opposed rear end associated with the forward and rear ends of the firearm. The body defines a bore with a forward opening and a rear opening. An elongated insert is received in the bore and has a rear end and a forward end. The insert and body have an insertion limiting facility configured to admit insertion of the insert with the rear end of the insert inserted via the forward opening of the bore, and to prevent passage of the insert beyond a limited insertion amount. The insertion limiting facility may include the bore defining a step, a greater bore width forward of the step and lesser bore width rear of the step.

21 Claims, 5 Drawing Sheets

FIBER OPTIC HANDGUN SIGHT

CROSS-REFERENCE TO RELATED APPLICATION

This application claims the benefit of U.S. Provisional Patent Application No. 63/409,381 filed on Sep. 23, 2022, entitled "FIBER OPTIC HANDGUN SIGHT," which is hereby incorporated by reference in its entirety for all that is taught and disclosed therein.

FIELD OF THE INVENTION

The present invention relates to firearms, particularly sights for a handgun. Specifically, illuminated sights.

BACKGROUND AND SUMMARY

Sights used for firearms may implement fiber optic pieces to gather and refract light to present a single or set of illuminated dots to an end user for enhanced target acquisition. Typical fiber optic handgun sights use a system of cylindrical length of plastic that refracts light to create an illuminated end. The sights are formed of material that is a transparent plastic with a fluorescent material that receive ambient ultraviolet light from the sides of the "fiber" and emits visible light from the fluorescing particles, visible vividly at the ends to present an illuminated appearance.

The fibers are installed in typically metal sight bodies that have conventional notch and post configurations. Fiber optic installation typically requires a heat source applied to each end of the fiber to secure the fiber in the desired position within the sight. This approach and method of installation presents several disadvantages. The installation may result in a poor fit and adhesion of the fiber to the frame of the sights and result in the fiber optic piece falling out due to violent recoil of the slide to which they are mounted. It also presents dangers both to the integrity of the handgun finish and to the user as the heat required may result in burns to the finish or human skin.

Additionally, because the fiber optic is sometimes exposed at both ends of its housing and is thus visible to both the end user and to any potential threat being addressed, posing a danger to the end user. The fiber optic often is recessed within the sight housing, allowing less light to be gathered and thus less visibility of the sights. Further, dirt and debris can become lodged in the recessed area and diminish visibility.

Accordingly, there is a need for a handgun sight system having a better means of installing the fiber optic pieces into the sight housing. The above disadvantages are addressed by a fiber optic sight system using a set screw to secure the fiber optic piece into a sight housing. This sight improves the modularity and functionality of the fiber optic handgun sight concept by using a mechanical means of changing the fiber rod without introducing heat. This sight also improves upon other similar designs in that the replaceable fiber rods are of a proprietary stepped design that allows the rods to be captured without compressive forces, but may be firmly secured to avoid movement within the sight body and retained mechanically with a threaded fastener while extending beyond the opening in the sight body, thereby offering a crisper view of the fiber and higher visibility of the fiber when installed. Also, a feature of this design is the use of fasteners from the muzzle end of the handgun which would direct the fastener and rod forward away from the user in a case where the fastener became loose or failed.

DETAILED DESCRIPTION OF A PREFERRED EMBODIMENT

Figure 1:
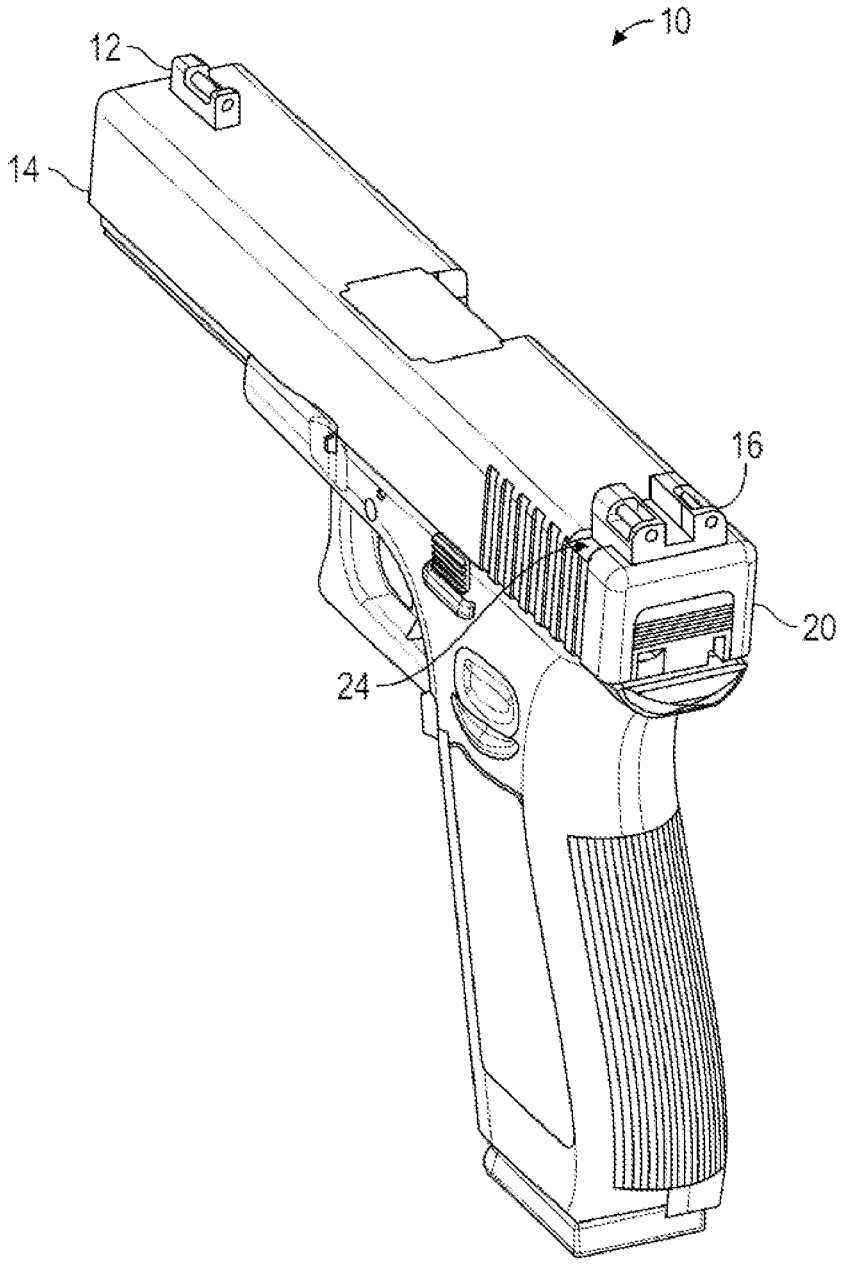
FIG. 1 is a firearm according to a preferred embodiment of the invention with the sights installed.

FIG. 1 shows a handgun 10 with the sights installed. There is a firearm front sight 12 with a fiber optic insert installed on the slide towards the muzzle end 14 of the handgun, and a set of rear sights 16 with fiber optic inserts installed towards the opposite end of the handgun slide 20. The sights can be installed via a conventional dovetail channel, slot, and/or pocket within the top surface of a handgun slide within the top surface of a handgun slide 24. One channel runs transversely across the end of the handgun having the muzzle. Another channel runs across the opposite end of the gun 24. In other embodiments, not shown, the sight may be installed via other methods, such as by a threaded screw.

The housing for either the front sight or the rear sight may have one window, or multiple windows. The term window in this case refers to pockets that provide the sides of the middle portions of the fiber rod with lateral access to light. In one embodiment, the sight housing may feature two such windows per bore, separated by a dividing septum that also provides support for an insert within the housing. The window septum arches over the bores that pass through the sight body. In other embodiments, additional windows may be formed by additional dividing walls of the housing. This can offer the inserted piece greater protection from external impact and dirt or debris. In yet another embodiment there are no windows, for when an insert does not need to be of such nature as to transmit ambient light. This offers the greatest protection to any insert used. In the embodiment shown in FIG. 1 the insert can be seen from the side, with at least one window utilized for either or both front and rear sights.

FIG. 1 further shows that the insert is not visible from the direction facing the muzzle end of the sight housing of either front sight or rear sight. The insert is visible from the rear end of the handgun.

Figure 2:
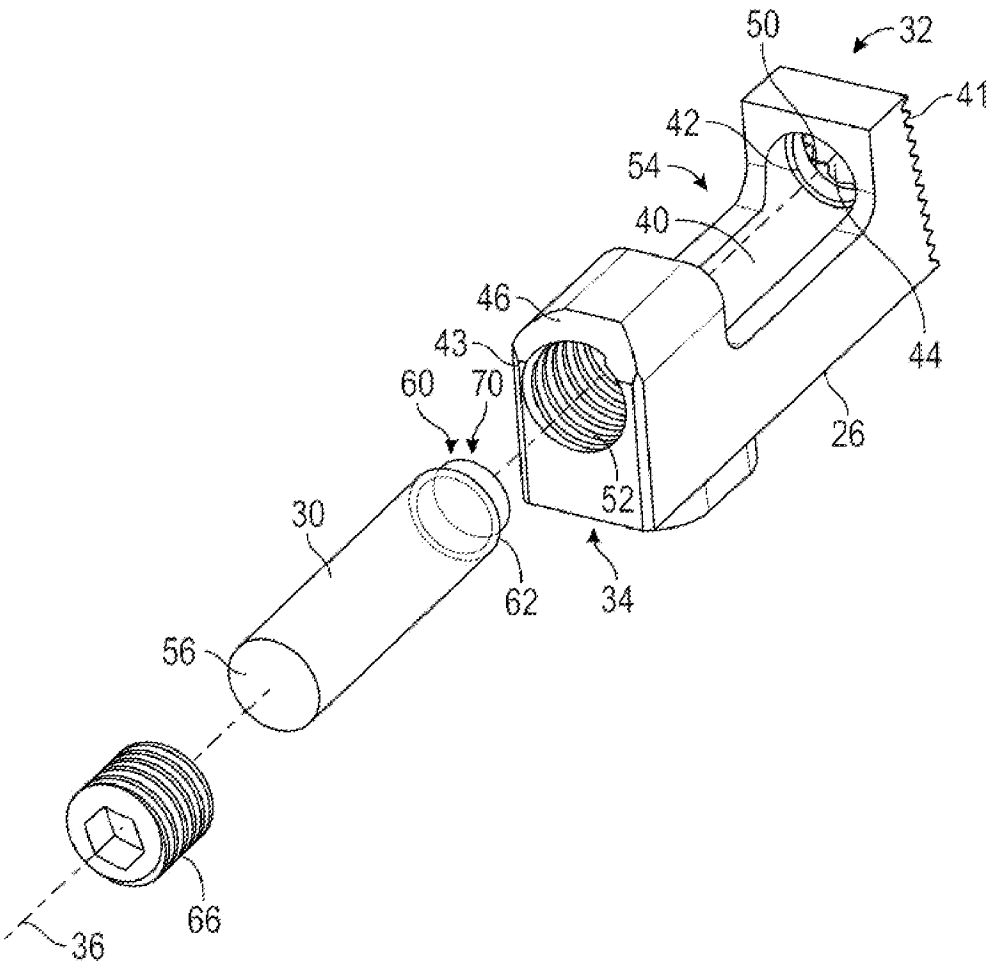
FIG. 2 is an exploded view of the front sight of the embodiment of FIG. 1.

FIG. 2 shows a single front sight housing 26 and a single fiber optic insert 30 in an exploded view of the front sight with the components as it would be disassembled. In the illustrated embodiment, there is a housing 26, which can be made of a variety of materials, including but not limited to resins, steel, aluminum, and composites. The front sight housing has a first end 32 and a second end 34 linearly related to each other along an axis 36. The first end faces the shooter, and the second end faces the target. Within and between these ends is a cylindrical bore 40 extending horizontally from the front surface 41 to the rear surface 43.

The bore may also be referred to as a channel, that proceeds linearly along a bore axis 36 through the entire housing, open on both ends.

The first end 32 of the housing has an internal rear-facing counter-bore shoulder 42 that narrows the channel a set distance to a diameter less than that of the main bore diameter before the channel's opening 44 at the first end 32 of the housing. The second end of the housing 34 is internally threaded 52. Part of the channel between the two ends is exposed at the top and sides, forming window 54 that exposes the fiber to ambient light. In one embodiment this opening is a single window, and in another embodiment the open portion is divided into multiple windows with a reinforcing and protective bridge at the midpoint.

The channel 40 may be formed by multiple means. For example, in an embodiment where the sight housing is formed by a machining process, the channel may be bored out. In embodiments where the housing is cast, the channel may be part of the cast design. In yet other embodiments such as when 3D printed, the housing forms around the channel due to an absence of material being placed upon the layers in a collection of layers.

FIG. 2 further depicts an insert 30 that is placed into the channel 40 from the second end 34 through the threaded portion 52 in a predominantly similar direction of travel as the channel when going from the second end 34 towards the first end 32.

The insert piece 30 is a cylindrical body, and may take on a variety of shapes in a predominantly uniform first width or diameter 56 and having a step-down end 60 with a second diameter 70. This step-down end 60 forms a frustoconical tapered nose that protrudes from the main body of the insert 30 having the first diameter 56. In this embodiment the insert piece is cylindrical first radius sized to be closely received in the sight bore and has a step-down end or nose 60 of a second radius 70 sized to be closely received in the aperture at the rear of the sight body, creating a rear-facing shoulder disc on the insert. The insert is machined, molded, or formed in some other process, such as 3D printing, to create the shoulder 62 and extension 60.

The step 62 of the insert 30 abuts the shoulder 42 of the counter-bore 50. The nose of the insert 60 protrudes beyond the counter-bore step 42 and may be recessed within, flush with, or protruding beyond the first end of the sight housing 32.

The insert may embody multiple rear end nose surface shapes. In one embodiment, the insert 30 is a fiber optic piece having a convex surface, increasing visibility to the end user.

The step-down end of the insert 60 may protrude beyond the sight's housing to provide the advantage of not having dirt or debris accumulate within the gap or a recess generated when having an insert is recessed within the housing. Alternatively, an insert may be flush with or recessed within the housing entirely. This offers protection for the insert piece from external damage or corruption. In one embodiment, the insert may be a simple cylinder free of a nose, and the rear surface abutting the shelf The insert piece is seated within the housing, having the step-down end 60 abuts the step 64 at one end of the housing with the shoulder 62 pressing against the shelf 64, and is secured from backing out by a set screw 66 threaded into the second end 34 of the housing having a threaded surface 52. The set screw 66 abuts the larger forward end of the insert 30 and is out of the view of the end user, on the second end 34 facing the target. This provides safer conditions for the end user as it decreases their visibility to a potential threat from a lack of light exposure emitting from, or reflected by, the insert where it to be visible to a threatening party.

The set screw 66 has a nylon thread-locking material either sprayed as a liquid or applied as a patch onto its threads to help prevent the set screw from inadvertently backing out from the recoil or vibrations it may experience. In other embodiments, a mechanical thread locking means is not used so as to allow replacement of insert pieces should they become damaged, or the user wants a different color, type, or application.

The insert is captured without compressive forces, but may be firmly secured to avoid movement. The portion of the insert having the second radius 70 extends into the smaller counterbore 50 and is visible at the rear face of the sight 32. No heat is required for securing or replacing the insert.

Figure 3:
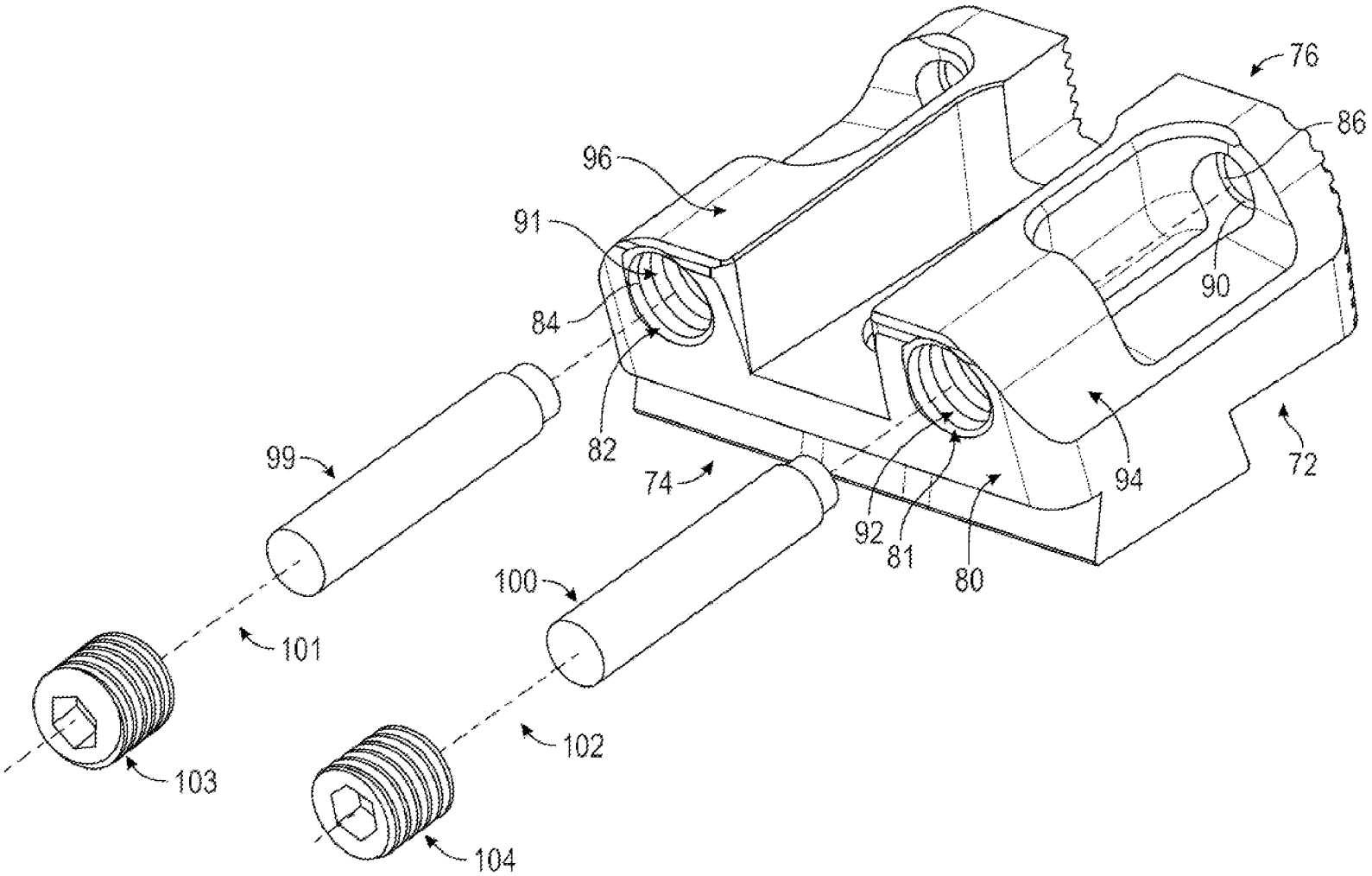
FIG. 3 is a view of the rear sights of the embodiment of FIG. 1.

FIG. 3 depicts a rear sight 72 comprising of a housing 74 having a first end 76 oriented towards the user of a handgun, and a second end 80 oriented towards the direction of the muzzle of the handgun. The housing is divided into a first lateral side 94 and a second, opposing lateral side 96. Each side of the housing has a bore 81 and 82, also called a channel, having a first diameter 84 spanning the majority of the channel from the second end 80 towards the first end 76. Each channel has at the first end of the rear sight housing 76 a counter bore 86 of a second diameter 90 narrower than the first diameter 86. At the second end of the housing 80 for each channel is a threaded section 91 and 92. This arrangement for the first lateral side 94 and second lateral side 96 of the rear sight 72 is similar to that of the front sight of FIG. 2 as described in preceding paragraphs.

There are two inserts 99 and 100 having the same description as in the preceding paragraphs regarding the front sight. The inserts 100 are likewise inserted into the rear sight housing 74 from the second end 80 through the bore 81 and 82 towards the first end 76 in a linear direction along a respective axis 101 and 102. The inserts 99 and 100 have the same relationship with their corresponding rear sight counter-bore in an equivalent manner as described above for the front sight. Each rear sight insert 99 and 100 is retained by one of two corresponding set screws 103 and 104 threaded into the threaded sections 94 of the second end 74 of the rear sight 72.

Figure 4:
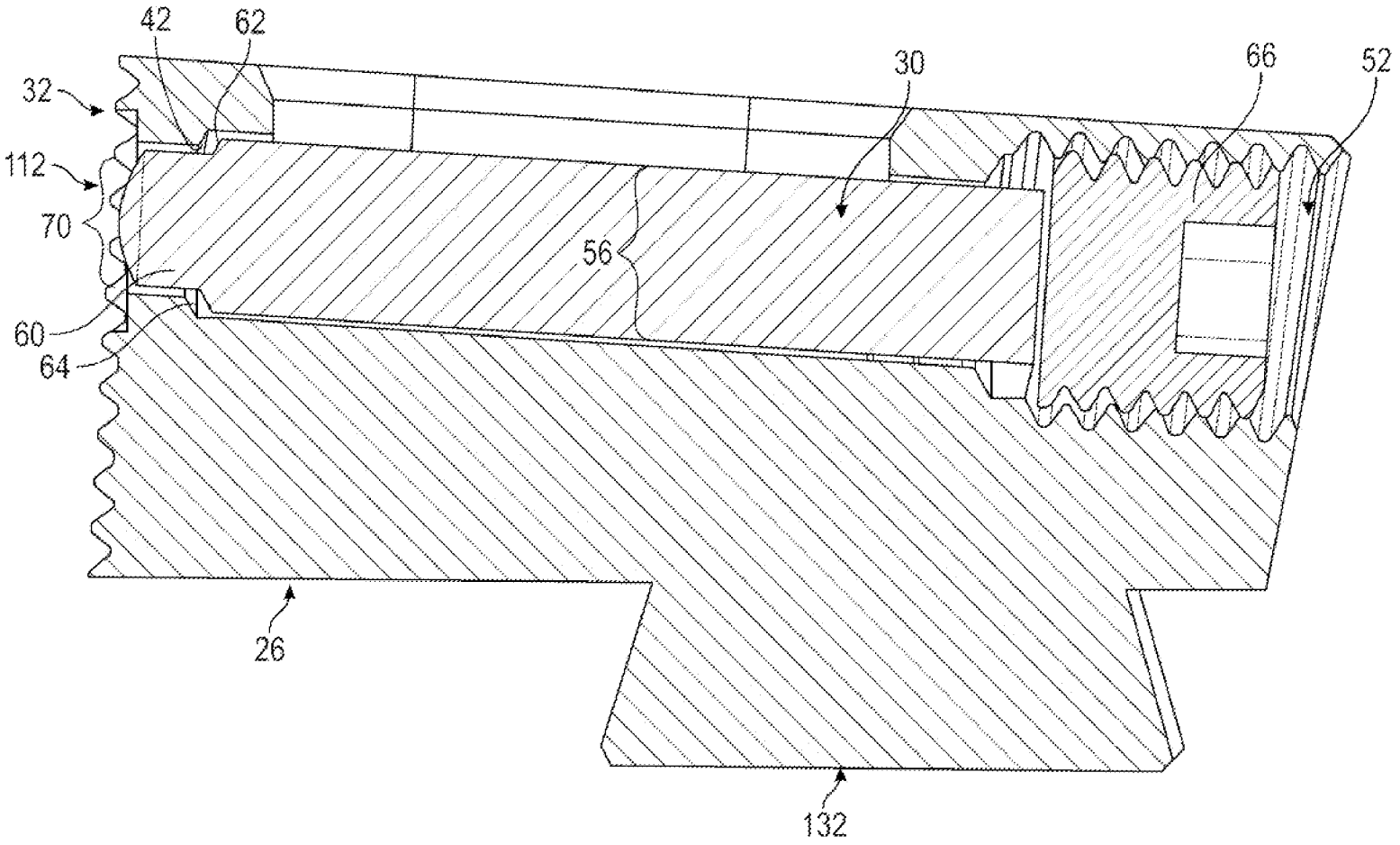
FIG. 4 side sectional view of the sight of the embodiment of FIG. 1.

FIG. 4 depicts a side view of one embodiment where the sight is fully assembled. The sight housing body 26 contains a fully seated insert 30. The insert having a first end 112 towards a first end of the sight housing 32, said first end of the insert 60 having a step-down end 60 comprising of a protruding portion with a diameter or cross sectional length 70 different from that of a diameter or cross sectional area 56 of the main body of the insert 30, forming a shoulder region 62 in contact with a counter-bore step 64 of the first end of the sight housing 32. The insert 30 is retained within the sight body 26 by a set screw 66 threaded into the second end 52 of the sight housing. FIG. 4 further depicts a protruding dovetail body 132 of the sight housing that interfaces with the slide of a firearm. The embodiment shown has room for the set screw for complete seating with no spaces between the shoulder and shelf. The insert diameters are depicted undersized with a gap from the bore, but in practice these are preferably a close slip fit without an excessive gap. To the extent there is any gap, the step and shoulder will assist in centering the insert due to a taper interface.

Figure 5:
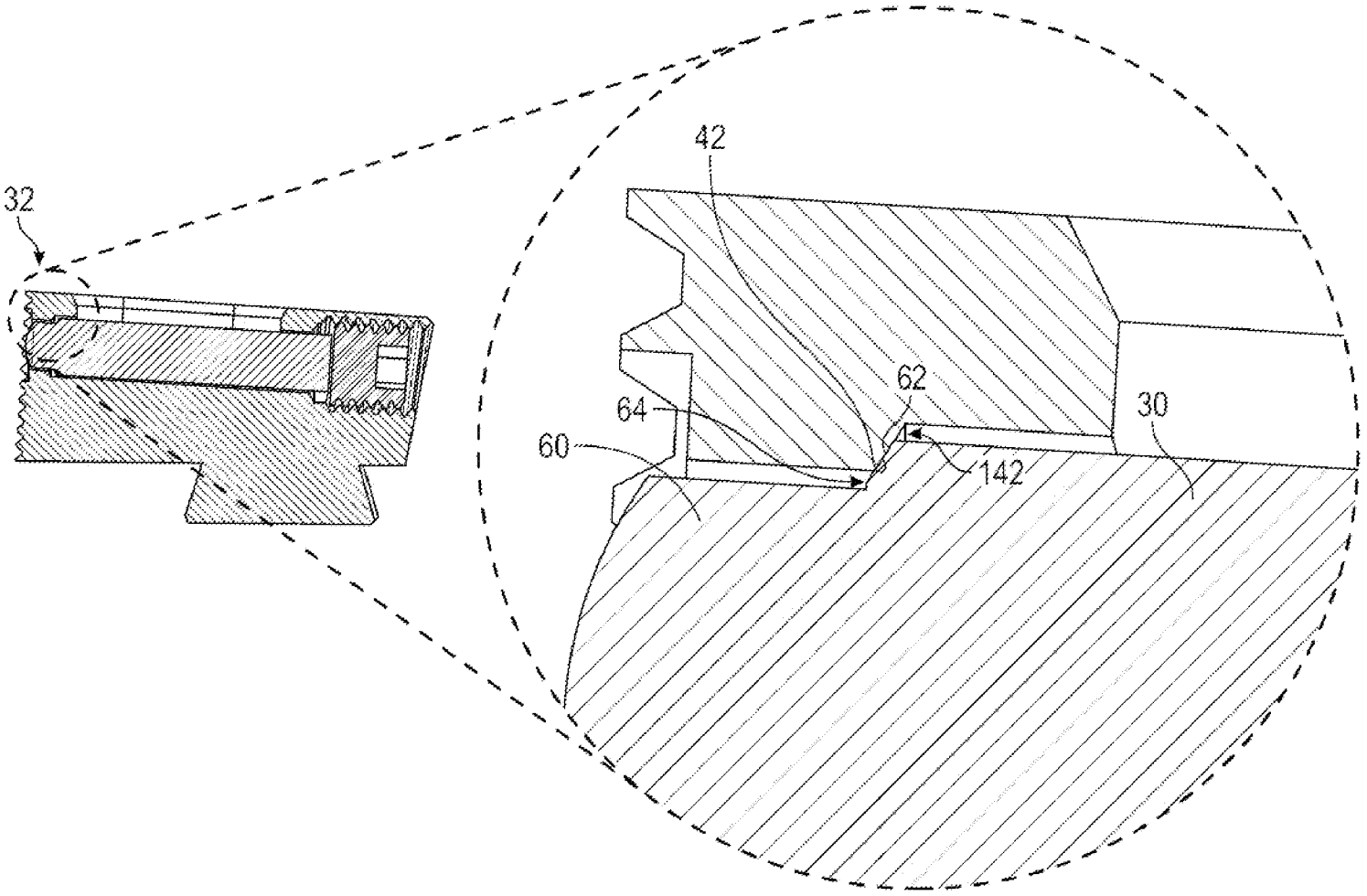
FIG. 5 shows an enhanced view of the front sight of FIG. 4.

FIG. 5 depicts an enlarged view of the shoulder-counter-bore step interaction of first-end portion of the sight depicted in FIG. 4. The first-end 32 of the sight has a counter-bore shoulder 42 and corresponding shoulder 64 of the step-down end of the insert 60 abuts the step 62. The step-down end 60 can protrude beyond the sight housing first end 32 or be flush with the housing. The insert diameters are depicted undersized with a gap from the bore, but in practice these are preferably a close slip fit without an excessive gap. To the extent there is any gap, the step and shoulder will assist in centering the insert due to a taper interface.

The insert 30 is retained within the sight body 26 by a set screw 66 threaded into the second end 52 of the sight housing. FIG. 4 further depicts a protruding dovetail body 132 of the sight housing that interfaces with the slide of a firearm.

FIG. 5 depicts an enlarged view of the shoulder-counter-bore step interaction of first-end portion of the sight depicted in FIG. 4. The first-end 32 of the sight has a counter-bore shoulder 42 with angle 142, abutting the step 62 of the step-down end of the insert 60 having corresponding angle 64. The step-down end 60 can protrude beyond the sight housing first end or be flush with the housing. The insert diameters are depicted undersized with a gap from the bore, but in practice these are preferably a close slip fit without an excessive gap. To the extent there is any gap, the step and shoulder will assist in centering the insert due to a taper interface.

In an alternate embodiment, the step-down end with shoulder and the counter-bore with step is at the second end of the sight housing. That is, as opposed to a small nose with a reduced diameter, the insert takes the form of a nail with a head adjacent to the set screw. In this embodiment, the main body of the insert has a first end extending towards the first end of the sight housing as in the front sight first end 32, and a second end that is oriented towards the second end of the sight housing as in the second end 34 of the front sight housing. However, the majority of the main body of the insert is a narrow shaft, with the second end having a larger diameter than the main body forming a step. The channel would have a first larger diameter at the sight housing's second end, such as at the set screw, and a second smaller diameter forming the majority of the length of the channel so as to accommodate the main body of the insert. The insert's larger diameter second end abuts the narrowing portion of the main bore channel having a narrower diameter. Once inserted fully where the insert's step from the second end presses against the shoulder of the bore, a set screw is threaded into the second end and secures the insert. This may be advantageous when wanting to have a front sight present a smaller dot to set between the complementary dots of the two posts of the rear sight in order to present a clearer sight picture.

The insert may comprise a variety of materials. In one preferred embodiment, it may be a fiber optic piece. In another embodiment it may be comprised of brass. In yet other embodiments the insert may be of steel, aluminum, resin, composite, or Delrin.

The nose 60 of the insert 30 may have a coating that provides contrast against the sight housing and the insert itself In one embodiment this coating may be a phosphorescent self-illumination material. In another it may be Teflon. In other embodiments a part of the tapered portion of the insert may be tritium.

The firearm sight comprising: a body having an attachment facility configured to connect to a pistol having a forward target end and a rear end; the body having a forward end and an opposed rear end associated with the forward and rear ends of the firearm; the body defining a bore defining a forward opening and a rear opening; an elongated insert received in the bore and having a rear end and a forward end; the insert and body having an insertion limiting facility configured to admit insertion of the insert with the rear end of the insert inserted via the forward opening of the bore, and to prevent passage of the insert beyond a limited insertion amount. The insertion limiting facility includes the bore defining a step, with a greater bore width forward of the step and lesser bore width rear of the step wherein the step is proximate the rear aperture and the insertion limiting facility includes the insert defining a shoulder. The insertion limiting facility includes the body bore defining a forward-facing surface and the insert having a rear-facing surface, and forward- facing surface of the body abutting the rear facing surface of the insert. The insert is admitted to the bore only via the forward direction. The forward opening of bore is larger than the rear opening.

I claim:

1. A firearm sight for a firearm defining a rear direction facing a shooter, the sight comprising:

a housing having a first end facing the rear direction and a second end facing an opposite forward direction;

the housing defining a channel;

the channel including a stop surface facing the forward direction;

an elongated insert within the channel, and having a rear end portion visible from the rear direction;

the elongated insert being optically transmissive along substantially its entire length and substantially filling the channel;

the elongated insert having a limiting surface abutting the stop surface; and wherein the stop surface of the housing is proximate a rear of the housing.

2. The sight of claim 1 including a plug secured to a forward end of the bore, forward of the elongated insert to retain the elongated insert.

3. The sight of claim 2 wherein the plug is a set screw.

4. The sight of claim 2 wherein the plug obscures visibility of the elongated insert from a forward direction.

5. The sight of claim 1 with the elongated insert being retained at one end with a set screw obscuring the opening of the channel entirely at one end.

6. The sight of claim 1 wherein the elongated insert is a fiber optic element.

7. The sight of claim 1 wherein the elongated insert has a convex rear end surface.

8. The sight of claim 1 wherein the stop surface of the housing is a frustoconical tapered surface.

9. The sight of claim 1 wherein a rear portion of the elongated insert protrudes from the housing.

10. The sight of claim 1 wherein a forward end of the channel is internally threaded.

11. The sight of claim 1 wherein the elongated insert has a rear end portion narrower than a width of a forward portion of the elongated insert.

12. A firearm sight for a firearm defining a rear direction facing a shooter, the sight comprising:

a housing having a first end facing the rear direction and a second end facing an opposite forward direction;

the housing defining a channel;

the channel including a stop surface facing the forward direction;

an elongated insert within the channel, and having a rear end portion visible from the rear direction;

the elongated insert being optically transmissive along substantially its entire length and substantially fills the channel;

the elongated insert having a limiting surface abutting the stop surface; and wherein the elongated insert has a rear end portion narrower than a width of a forward portion of the elongated insert.

13. The sight of claim 12 including a plug secured to a forward end of the bore, forward of the elongated insert to retain the elongated insert.

14. The sight of claim 13 wherein the plug is a set screw.

15. The sight of claim 13 wherein the plug obscures visibility of the elongated insert from a forward direction.

16. The sight of claim 12 with the elongated insert being retained at one end with a set screw obscuring the opening of the channel entirely at one end.

17. The sight of claim 12 wherein the elongated insert is a fiber optic element.

18. The sight of claim 12 wherein the elongated insert has a convex rear end surface.

19. The sight of claim 12 wherein the stop surface of the housing is a frustoconical tapered surface.

20. The sight of claim 12 wherein a rear portion of the elongated insert protrudes from the housing.

21. The sight of claim 12 wherein a forward end of the channel is internally threaded.

* * * * *